United States Patent [19]

Linde et al.

[11] 4,117,617

[45] Oct. 3, 1978

[54] ADJUSTABLE SIGHTING RIB

[75] Inventors: John P. Linde, Richfield Springs, N.Y.; Martin W. Kopinski, Houston, Tex.; Donald R. Lewis, Little Falls, N.Y.

[73] Assignee: Remington Arms Company, Inc., Bridgeport, Conn.

[21] Appl. No.: 838,135

[22] Filed: Sep. 30, 1977

[51] Int. Cl.[2] ..... F41G 1/00

[52] U.S. Cl. ..... 42/1 S; 33/233; 33/252

[58] Field of Search ..... 42/1 S; 33/233, 252, 33/254

[56] References Cited

U.S. PATENT DOCUMENTS

| | | | |
|---|---|---|---|
| 1,100,596 | 6/1914 | Mau | 42/1 S |
| 1,137,477 | 4/1915 | Godshalk | 42/1 S |
| 1,485,064 | 2/1924 | Berger | 42/1 S |
| 4,010,564 | 3/1977 | Pettit | 42/1 S |

*Primary Examiner*—Charles T. Jordan

*Attorney, Agent, or Firm*—Nicholas Skovran; William L. Ericson

[57] ABSTRACT

An adjustable sighting means for a firearm which a shooter can adjust to give the desired point of impact. An elongated rib is adjustably mounted on the gun barrel. The rib can be adjusted in the vertical direction so that the forward end of the rib has a greater vertical movement than the rear end of the rib. The effective pivot point of the rib is to the rear of the rib at a theoretical point which remains constant and is selected to be the position of an average shooter's eye when in shooting position.

25 Claims, 16 Drawing Figures

ADJUSTABLE SIGHTING RIB

This invention relates in general to an adjustable sighting means for a firearm, e.g. a shotgun, that the shooter can adjust to result in a desired point of impact. More specifically, the invention relates to an elongated sighting means that is adjustable vertically at its front and rear mounting connections to the gun barrel. Still more specifically, the invention relates to an adjustable vent rib that pivots about the shooter's eye rather than at one of the mounting connections to the gun barrel.

It is reasonable to say that no two shooters hold a gun exactly the same, see the same thing when they pull the trigger, or react to gun recoil the same. Since all of these considerations affect the point of impact, it becomes apparent that no mass produced gun will satisfy the point of impact preference of all shooters. With a plain barrel, shooters sometimes can bend the barrel to alter the point of impact. However, in competition shooting, most shotguns have ventilated ribs that are very difficult to bend without deforming the ventilated rib.

Another method used by trap shooters to raise their point of shot impact is to put on a straighter gun stock, i.e. raise the top surface of the stock. This requires the shooter to raise his eye with respect to the ventilated rib sighting surface. In this position the shooter is no longer sighting right down the rib but can see the top surface of the rib. The shooter, thus, is raising the point of shot impact by altering his gun stock in order to change his sight picture.

The most critical dimension of the gun stock is the stock drop, i.e. the distance between the stock and a projection of the ventilated rib sighting surface back over the stock to the stock comb. See FIG. 1 of the drawing. In target shooting, the shotgun must fit the shooter. The sighting is accomplished by having the shooter's eye line up with the top plane of the ventilated rib and sights so the shooter can guide the gun to the correct point in front of the moving target before discharging the gun. With the shooter's eye in this position it is important that the shooter's face make contact with the stock in a comfortable position that can be repeated shot after shot for best performance. If the stock is too low, the shooter must lift his head off the stock to see down the rib. With the head off the stock, it is more difficult to be consistent in aiming. If the stock is too straight or high, the shooter will see the top rib surface so that the gun will probably shoot high. Moreover, the shooter will be absorbing more of the recoil in his head which will tend to lower his endurance and cause misses.

The invention proposes to adjust the gun rather than have the shooter adapt himself to the gun. Conventionally, if the gun would shoot low, the shooter would have to compensate on each shot. Obviously, the more a shooter has to compensate, the greater his chances are for error.

Recently, Simmons Gun Specialities, Inc. has advertised an "Exact-Impact Adjustable Ventilated Rib" in a brochure entitled "The New Simmons Exact-Impact Adjustable Ventilated Rib". It is believed that this adjustable rib is shown in U.S. Pat. No. 4,010,564, issued to C. E. Pettit on Mar. 8, 1977. However, the concept shown in the Pettit patent differs from the present invention in that the rear end of the rib is mounted on a fixed pivot pin at the breech. There is no differential pivoting of the rib so that the pivot point is the shooter's eye.

The present invention uses the shooter's eye position as a center and rotates the position of the rib about this center. If the ventilated rib is adjusted, the barrel would then move up or down with respect to the rib, thus changing the point of impact with a given sight picture. Because the rib moves about the shooter's eye, the drop of the stock at the comb remains constant. (See FIG. 1 for an explanation of "drop of the stock at the comb".) Thus, the comb stock drop dimension does not vary with changes in the position of the rib. The distance from the shooter's eye to the comb stock does change when it becomes necessary for the shooter to remove his check from the stock and compensate for shooting high or low, as mentioned above, i.e. when the shooter adapts to the gun rather than adjusting the gun to shoot where he wants it to. The position of the shooter's eye is the only place the rib can be pivoted from that will not affect the stock drop.

Another way to visualize the concept is that if the shooter sights in on a fixed object, the barrel will be pointing to a given place. If the rib is adjusted and the shooter again sights to the fixed object, the barrel will be pointing to a different place. Thus, with the same sight picture the gun will be shooting to a different point of impact.

A primary object of the invention is to provide an adjustable rib for a firearm that is easily adjusted and permits a shooter to adjust his point of impact without affecting the stock drop.

Another object of the invention is to provide an adjustable rib for a firearm wherein a shooter can adjust the gun to shoot where he wants it to under his specific shooting conditions and with a given sight picture.

Other objects and advantages will become apparent from the following description taken in conjunction with the accompanying drawing in which.

Figure 9:
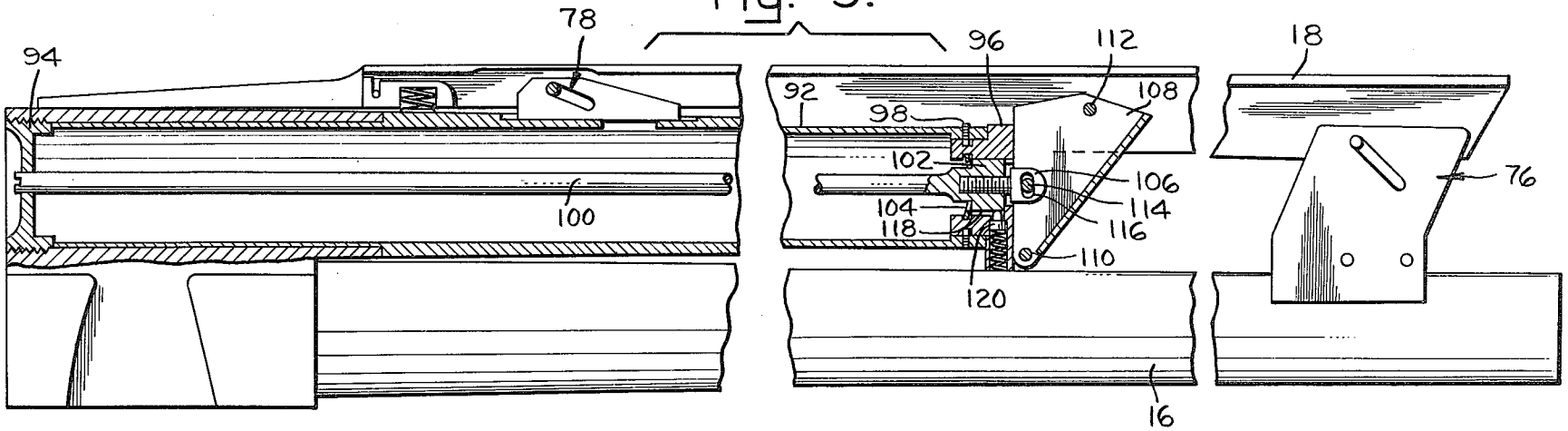
FIG. 9 is a longitudinal cross-sectional view of the barrel assembly and adjustable rib of FIG. 1.

9 except that the adjusting bracket slides rather than pivots as FIG. 9.

Figure 11:
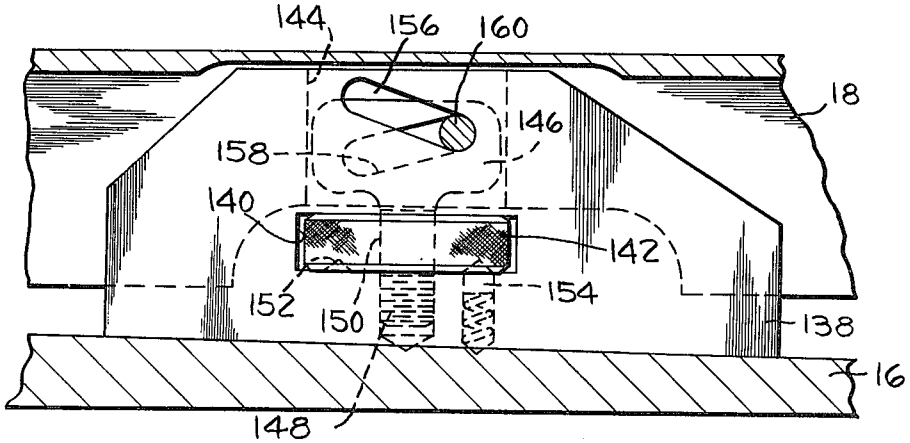

FIG. 11 is a longitudinal cross-sectional view of an opposing cam type adjuster means.

Figure 12:
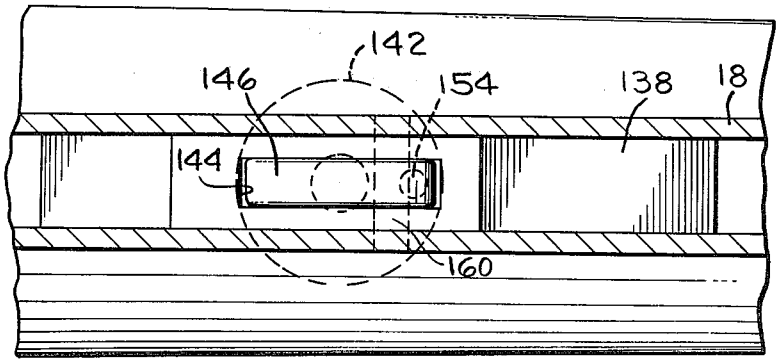

FIG. 12 is a top view of the modification shown in FIG. 11.

Figure 13:
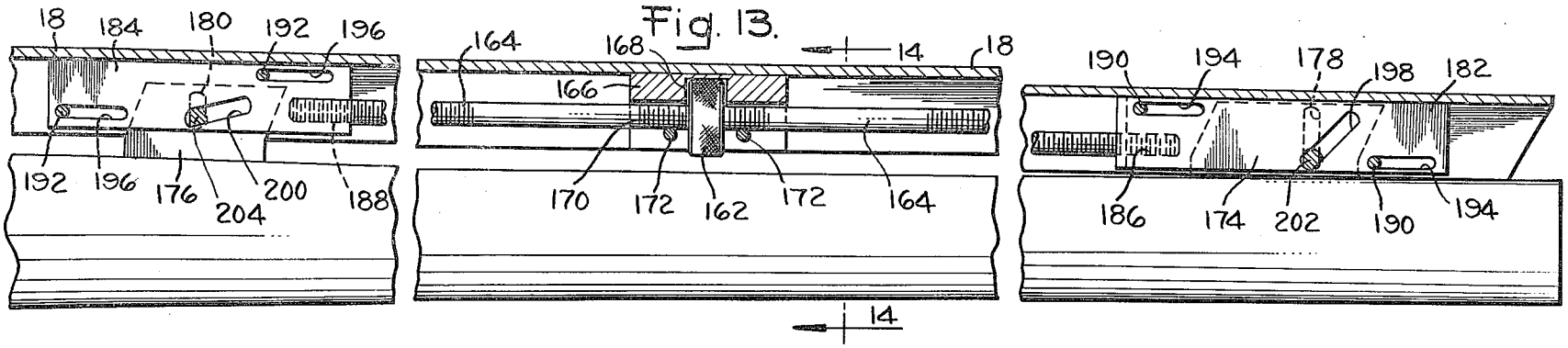

FIG. 13 is a side view, cross-sectional in part, of a tie screw modification of differentially elevating the front and rear ends of an elongated sighting rib.

Figure 14:
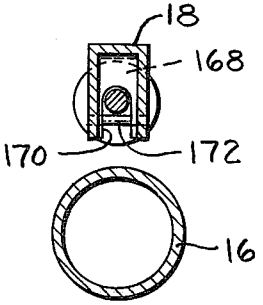

FIG. 14 is a view taken along Line 14—14 of FIG. 13.

Figure 15:
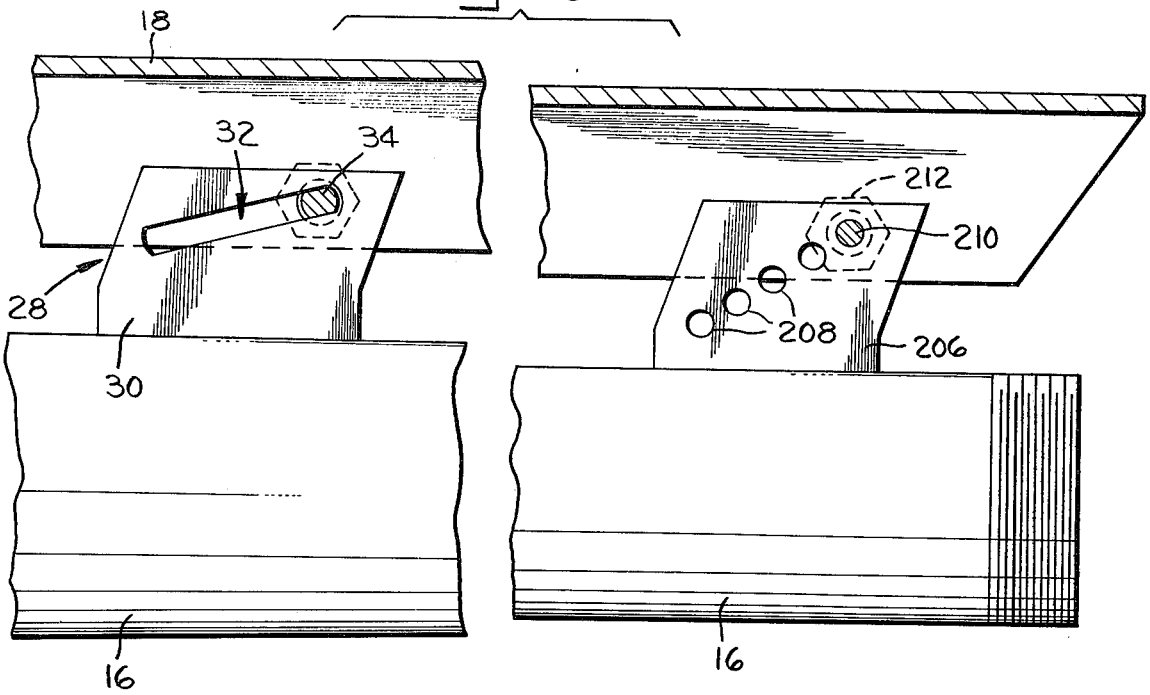

FIG. 15 is a side view, cross-sectional in part, of a pinned front adjuster modification.

Figure 16:
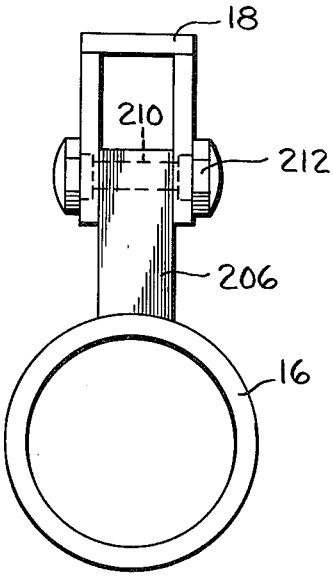

FIG. 16 is a front view of the modification shown in FIG. 15.

Figure 1:
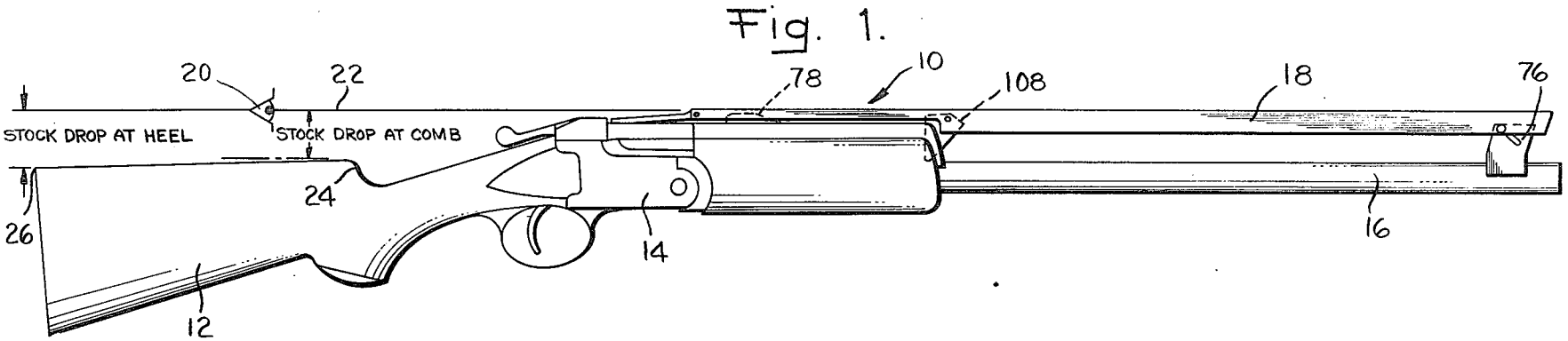
FIG. 1 is a side view of a firearm with a preferred elongated and adjustable sighting rib.

FIG. 1 shows a single barrel shotgun 10 having a stock 12, a receiver 14, and an elongated barrel 16 to which a sighting rib 18 is attached. For the purposes of describing the invention, an eye 20 is shown in a position that is intended to be the comfortable firing position of a shooter when he places his cheek on the stock shown. The terms "stock drop at comb" and "stock drop at heel" are the dimensions from the projected line or plane 22 of the top of the sighting rib 18 and the stock comb 24 and stock heel 26 respectively. These dimensions are important in "fitting" the gun to the shooter so that he is comfortable in sighting along the top surface of the rib when the stock is positioned properly against his face and his shoulder. As mentioned above, when the gun does not fit properly and the shooter has to compensate — or move his head up or down from what is the optimum position in order to sight down the rib — the chances of error or misses are increased.

Although FIG. 1 shows a break-open type shotgun, the invention is applicable to fixed receiver type guns as well.

The drawings show a number of embodiments of the invention. In general, the sighting rib in all embodiments moves vertically at the rear and at the front ends of the rib and the effective pivot point in all cases is at the shooter's eye 20. The differences between the embodiments are in the means for adjusting the rib in the vertical direction.

Figure 2:
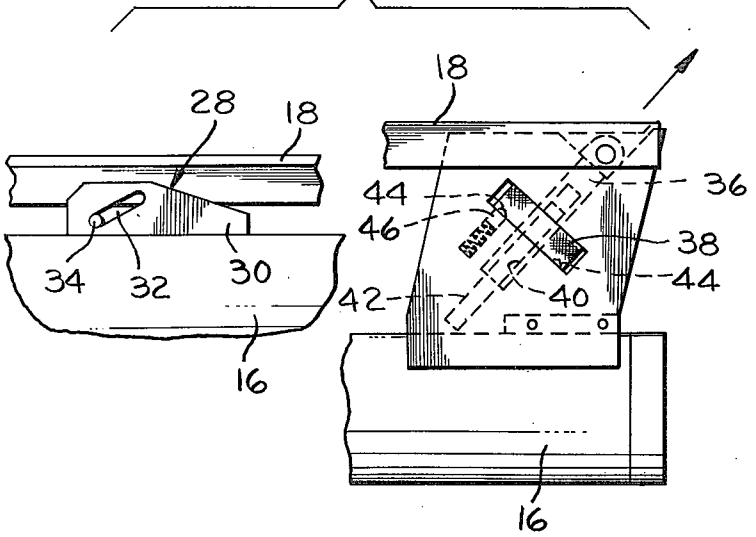
FIG. 2 is a side view of a modification of the invention showing an adjustable sighting rib pivotally mounted at its rear by means of an adjusting cam and showing a thumb wheel means for adjusting the front end of the sighting rib at the muzzle end of the barrel.

FIGS. 2–6 and 15 have a similar rear cam mounting 28 and different forward adjusting means. The rear cam 28 comprises a bracket 30 mounted on the barrel 16. Bracket 30 has an inclined cam slot 32 in which a pin 34 attached to the rib 18, rides. FIG. 2 shows a detent wheel type front adjuster where a threaded member 36 is attached at one end to the forward or muzzle end of the rib 18 and its other end is threadedly mounted in an adjusting detent wheel 38. The position of the threaded member is such that when the detent wheel 38 is rotated in a clockwise direction, the rib is moved upwardly and forwardly in the direction indicated in FIG. 2. This raises the line of sight which means the gun will shoot low. If it is desired to have the gun shoot high with the same sight picture, the detent wheel is rotated in the counterclockwise direction wherein the rib moves rearwardly and downwardly. The threaded member 36 has an elongated cavity 40 in which a guide pin 42, is positioned. The detent wheel 38 has a plurality of detents 44 spaced around its lower face, one of which is engaged by a spring biased plunger 46 to secure the wheel in the desired position.

Figure 3:
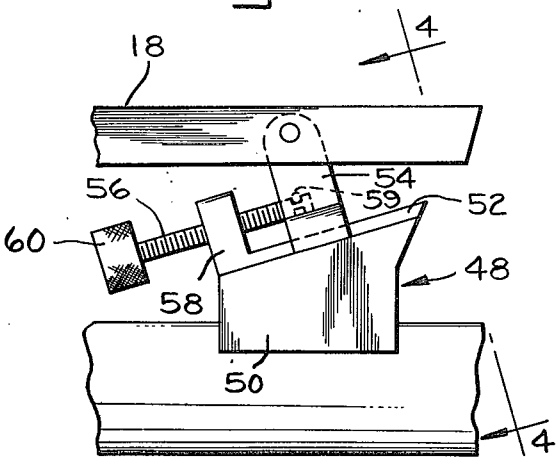
FIG. 3 shows another modification of the invention similar to the one shown in FIG. 2 except that the front end adjustment of the rib is effected by a screw-actuated slide mounted on the barrel.
Figure 4:
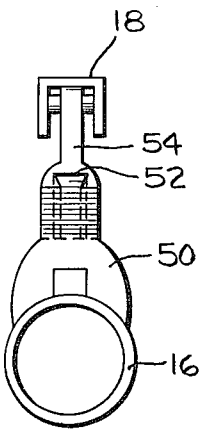
FIG. 4 shows a front end view of FIG. 3.

In FIG. 3, the rear cam mounting is similar to FIG. 2. In this embodiment or modification, the rib adjustment is made by a slide type front adjuster 48. This adjuster consists of a bracket 50 mounted on the barrel, a dovetail inclined surface 52 on the upper part of the bracket, a slide 54 attached to the rib 18 and slidably mounted on the dovetail surface 52. Slide 54 is movable along the inclined surface 52 by member 56 which is threadedly mounted on lug 58 of bracket 50 and pinned by pin 59 to slide 54 to permit rotation. A thumb screw 60 is used to actuate the adjuster.

The operation of the adjuster of FIG. 3 is similar to the adjuster of FIG. 2. By rotating the thumb screw 60 clockwise or counterclockwise, the slide 54 and the attached rib is raised and lowered along the plane defined by the inclined surface 52. In each of the embodiments, the vertical rise at the front end of the rib is greater than at the rear end of the rib so that the entire rib is moved and pivoted about the shooter's eye — as is shown in FIG. 1.

Figure 5:
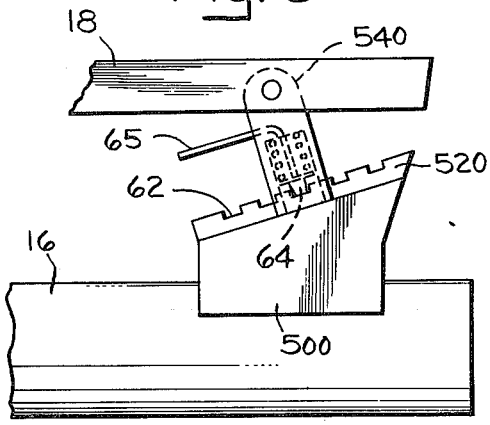
FIG. 5 is similar to the modification shown in FIG. 3 except that it shows a different front end adjustment of the rib.

The front end adjustment shown in FIG. 5 is similar in many respects to the structure shown in FIG. 3. Bracket 500 of FIG. 5 resembles bracket 50 of FIG. 3 except that the dovetail inclined surface 520 of FIG. 5 includes a series of detents 62. Slide 540 of FIG. 5 engages and slides on dovetail surface 520, and is held in the desired position by a spring biased plunger 64 (or it could be a ball) that engages one of the detents 62. A plunger handle 65 moves in a slot (not shown) in the slide 540 to permit the plunger 64 to be withdrawn from the detent when an adjustment in the position of the rib is to be made.

Figure 6:
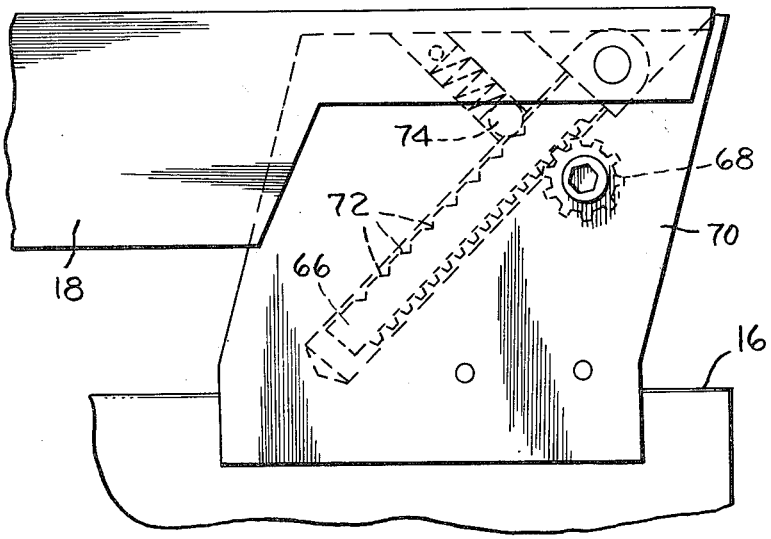
FIG. 6 shows another modification similar to FIG. 2 except that a rack and pinion means is used to adjust the front end of the sighting rib.

FIG. 6 has the same rear cam mount as FIG. 2. The forward end of the rib 18 is adjusted by a rack 66 attached to the rib and operably engaged with and actuated by a pinion 68 that is mounted on bracket 70 which is mounted on the barrel. The rack is movable upwardly and forwardly or rearwardly and downwardly by the pinion, depending on the desired adjustment. The side of the rack 66 that is not engaged by the pinion has a series of detents 72. The rack is secured in the desired position by means of a ball 74 (or it could be a plunger) that is spring biased into engagement with one of the detents 72.

Figure 8:
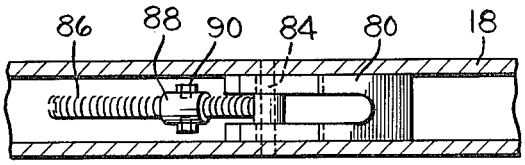
FIG. 8 is a top view of the rear cam arrangement of FIG. 7.
Figure 7:
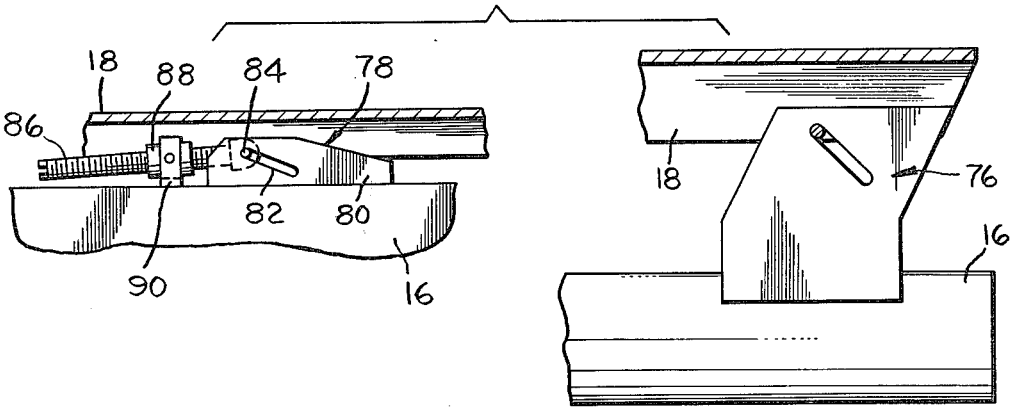
FIG. 7 is a side sectional view showing another modification of the invention with a sighting rib cammed at its front and rear ends and a threaded means to move the rib at the rear cam.

FIG. 7 shows the inventive concept in a slightly different form than the embodiments shown in FIGS. 2–6. Rib 18 is adjustably mounted to the barrel by a cam means 76 at its front end and an adjustable cam means 78 adjacent its rear end. Adjustable cam means 78 comprises a bracket 80 having a slot 82 in which a pin 84 is mounted. Pin 84 is attached to the rib 18 and connects the rib to the barrel through the bracket 80. Threaded actuating member 86 screws into a threaded block 88 that is pivoted to a U-shaped mount 90 which in turn is fixedly mounted to the top of the barrel 16. (See FIG. 8). The forward end of the actuating member 86 is connected to pin 84 so that upon rotation of member 86, the pin 84 — and the pin in the front cam means 76 — will be moved forwardly and downwardly (as seen in FIG. 7) so that the rib, connected thereto, will also move forwardly and downwardly relative to the barrel. Rotation of the actuating member 86 in the opposite direction will move the pin 84 rearwardly and upwardly thus raising the rib 18.

As mentioned above, FIG. 9 shows the barrel assembly and the preferred embodiment of the adjustable rib shown mounted on an assembled shotgun in FIG. 1. This embodiment shows front end cam means 76 and rear end cam means 78 similar to the cam mounting means shown in FIG. 7. It will be noted that the slope of the slot in the front cam means 76 is greater than the slope of the slot in the rear cam means 78. Because of this difference, which is present in all the various embodiments except the one shown in FIG. 13, a longitudinal movement of the rib causes a greater vertical displacement at the front end than at the rear end.

The embodiment of FIG. 9 thus provides front and rear adjustable cam means and an adjuster positioned intermediate the two adjustable cam means to vary the vertical and horizontal positions of the rib on the cam means, i.e. will raise and lower the rib relative to the gun barrel.

FIG. 9 shows a barrel 16 with a rib 18 adjustable mounted on front cam means 76 and rear end cam means 78. Front cam means is mounted on the front end of the barrel while rear cam means is mounted on a cylindrical member 92 which in turn is attached to the barrel mono-block. Cylindrical member 92 has a purpose which is not relevant to the present invention and thus is not discussed here. The cylindrical member is closed at its rear by a threaded breech plug 94 and at its front by a cylinder cap 96 that is held in place relative to the cylindrical member by retaining ring 98. An elongated adjuster rod 100 extends rearwardly through the breech plug. The forward end of the adjuster rod 100 has an enlarged portion 102 that fits the inside diameter of the cylinder cap 96 and is secured thereto by a cylinder cap flange (not numbered) at the front of the enlarged portion and a snap ring 104 at the rear of the enlarged portion. An adjuster screw 106 is threadedly connected at its rear to the enlarged portion of the adjuster rod and at its front to rib adjuster 108. Rib adjuster 108 is pivotally attached at its lower end by pin 110 to the cylinder cap 96, and at its upper end by pin 112 to the rib 18. The connection of the adjuster screw 106 to the rib adjuster 108 comprises a pin 114 attached to the adjuster 108, riding in a vertical slot 116 in the end of the adjuster screw.

As will be appreciated, rotating the adjuster rod 100 will cause the rib adjuster 108 to pivot about pin 110. The pin 114-slot 116 relationship permits sliding movement of the pins in their respective slots in the front and rear cams, 76 and 78. This pivoting movement of the adjuster will cause the rib to be raised or lowered — depending on the direction of rotation of the adjuster rod.

Positioned around the periphery of enlarged portion 102 of the rib adjuster rod are a series of longitudinal grooves 118. In lieu of grooves, detents could be used. Spring-biased detent means 120 engage one of said grooves and hold the adjuster rod — and the connected rib adjuster and rib — in the position desired.

Figure 10:
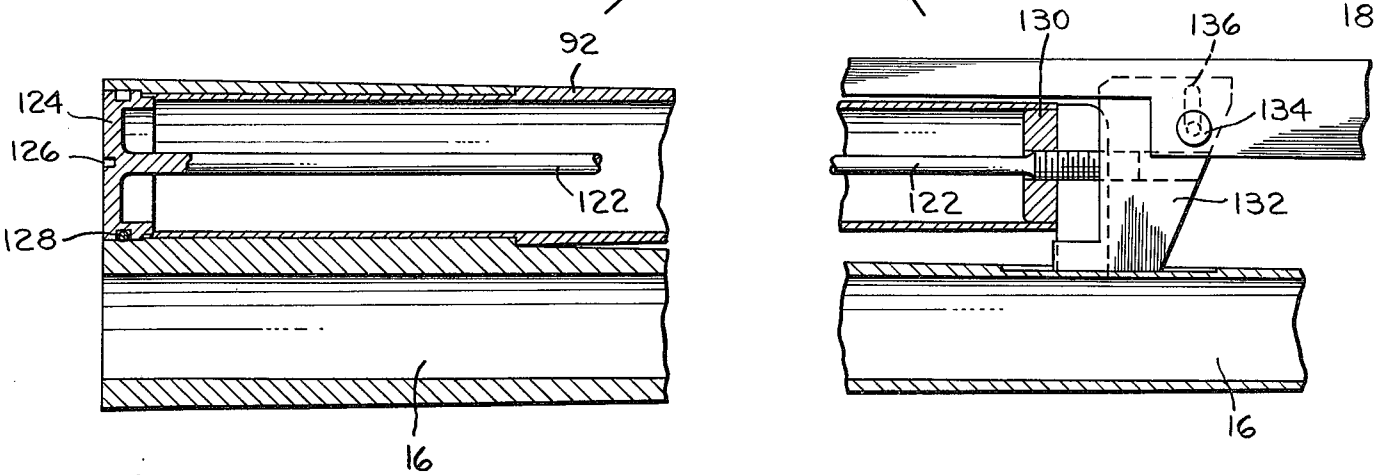
FIG. 10 is a longitudinal cross-sectional view of a modification of the invention showing a barrel assembly and adjustable sighting rib similar to that shown in FIG.

FIG. 10 shows another embodiment of the invention that is similar to the preferred embodiment of FIG. 9 in many ways. The actual adjustment is made at the rear of the barrel assembly, i.e. at the breech face by screwing or otherwise actuating an elongated adjuster rod 122 that extends through cylindrical tube 92 mounted on the barrel 16. The rear end of the adjuster rod 122 has a head 124 with a groove 126 which will accommodate a screwdriver or other tool to rotate the adjuster rod. Head 124, which acts to close off the rear end of the cylindrical tube 92, is retained in place by means of pin 128 which permits rotational movement of the head but prevents longitudinal movement.

The front end of adjuster rod 122 extends through cylinder cap 130, and is threaded to slide member 132. Cylinder cap 130 is rigidly mounted to the cylindrical tube 92. Slide member 132 is slidably mounted on the barrel and moves through a slot (not shown) in cylinder cap 130 upon rotational movement of the adjuster rod. The slide member is connected to the rib 18 by means of pin 134 which is positioned in vertical slot 136.

The adjuster means of FIG. 10 is used in combination with front cam means 76 and rear cam means 78, as shown in FIG. 9. It will be understood then that upon actuation or rotation of the adjuster rod 122, the slide member 132 is caused to move longitudinally so that the connected rib also moves longitudinally (forwardly or rearwardly, depending on the direction of rotation) so that the front and rear ends of the rib are cammed up or down on their differentially sloped cam means. The rib thus is raised or lowered and pivots at a point rearwardly of the rib, at the position of the shooter's eye. Thus, the shooter holds the gun in the same manner as he is used to and adjusts the point of impact of the gun while sighting and firing in this position.

FIGS. 11 and 12 show another modification using a finger operated, threaded member to effect raising and lowering of the rib. This adjusting means, as well as others, can be located at the front or at the rear of the rib. Obviously, it can also be used with or without an adjusting means at the opposite end from the adjusting means. For the purpose of this disclosure, we will assume it is located at the rear of the rib and in conjunction with a front cam means as shown in FIGS. 7 and 9.

Cam bracket 138 is rigidly secured to barrel 16 and is positioned within the inverted U-shaped rib 18, as can be seen in FIG. 14. The bracket has an opening 140 in which a cylindrical thumb wheel 142 is placed, and a groove 144 in which an adjuster member 146 fits snugly so as to prevent rotation. Adjuster member 146 is threaded at 148 to engage a threaded opening 150 in the thumb wheel so that upon rotation of the thumb wheel, the adjuster member moves up and down in the bracket groove — depending on the direction of rotation. The underside of the thumb wheel has a series of spaced apart notches 152 which can be engaged by spring biased detent 154 to lock the wheel and the adjuster member in a desired position.

Bracket 138 also includes a cam slot 156 whose lower end intersects with a cam slot 158 in the adjuster member 146. Adjuster pin 160 extends through the two cam slots and is attached to the side legs of the rib 18. Upon rotation of the thumb wheel, the adjuster member 146, which is confined in the bracket groove 144, is raised or lowered. This up and down motion of the adjuster causes a scissors effect on the adjuster pin 160 and forces it up and down the cam slots. For example, if the adjuster is moved up in FIG. 11, the pin 160 would move up bracket cam slot 156 and down adjuster cam slot 158 and the attached rib would be elevated.

FIGS. 13 and 14 show a modification in which the front and rear ends of the rib are connected by a tie screw assembly for simultaneous adjustment. A thumb wheel 162 is rigidly attached to a tie screw 164 to form an assembly which is secured to sight rib 18 by a guide block 166. The guide block has a vertical groove 168 in which the thumb wheel is positioned and a horizontal groove 170 in which the tie screw 164 is positioned and retained by pins 172 which also secure the guide block to the sight rib. See FIG. 14.

Attached to the barrel 16 are front cam bracket 174 and rear cam bracket 176. Bracket 174 has a vertical slot 178 and bracket 176 has a similar slot 180. Slidably attached to the rib 18 adjacent brackets 174 and 176 are front slide member 182 and rear slide member 184. The slide members are threaded to the tie screw 164 at 186 and 188 respectively and are connected to the rib by pins 190 and 192 and slots 194 and 196. Cam slots 198 and 200 are angularly disposed to and intersect slots 178 and 180 respectively. Front and rear cam pins 202 and 204 extend through slots 178, 198 and 180, 200 and are connected to rib 18.

The adjustment of the rib is done by rotating the tie screw 164 by means of the thumb wheel 162. This rotation of the thumb wheel causes one slide to be pushed and the other slide to be pulled relative to the rib and the cam brackets. As the thumb wheel is rotated, one slide is threaded in and at the same time the other slide is threaded out. The sliding action of the slides 182 and 184 causes a scissors effect on the cam pins 202 and 204 and forces the pins up and down in the cam slots. The cam pins 202 and 204 are rigidly attached to the rib. Because of the difference in the slope of cam slots 198 and 200, the front of the rib moves upward faster than the rear end of the rib. This causes the line of sight to be rotated about a point rearward of the rib, i.e. at the shooter's eye.

FIG. 15 shows a modification similar in many respects to the modifications of FIGS. 2, 3, 5, and 6 where the rear end of the rib is mounted on an adjustable cam means 28 and the front end of the rib is selectively mounted in order to provide the desired setting. A front bracket 206 is mounted on the forward or muzzle end of the barrel 16. A series of spaced-apart openings 208 are provided in the bracket to lie in an inclined line which has a slope greater than the rear cam means 28 so that movement along the axis of the openings 28 will cause a greater vertical movement at the front of the rib than at the rear of the rib. By selectively positioning a pin 210 in one of the openings, which pin is attached to the rib by a nut 212, the forward end of the rib can be raised and lowered in the manner indicated in the other modifications. Obviously, the slope of cam slot 32 and the series of openings 208 can be reversed and still accomplish the same result.

What is claimed is:

1. In a shotgun having a stock and a gun barrel through which a projectile means is fired, an adjustable sighting means for changing the point of impact of said fired projectile means with a given sight picture, said adjustable sighting means comprising an elongated rib, and means pivotally mounting said elongated rib on said barrel so that the rib pivots about a point rearwardly of said elongated rib and the drop of the stock at the comb remains constant throughout the pivotal movement of the rib.

2. In a shotgun as recited in claim 1 wherein said means pivotally mounting said elongated rib comprises a front slide means and a rear slide means slidably mounted on said elongated rib, cam means on each of said slide means, a guide block rigidly mounted on said rib intermediate said slide means, a tie screw means connecting said slide means and threadedly mounted thereto so that when the tie screw means is threaded into one slide means, it is unthreaded out of the other slide means, a thumb wheel mounted in said stationary guide block and rigidly attached to said tie screw means for actuating the tie screw means, front and rear bracket means mounted on the barrel adjacent said front and rear slide means, vertical slot means in said bracket means angularly disposed to and intersecting said corresponding cam means at its lower end, a cam pin extending through said slot means and said cam means and connected to said rib, whereupon rotation of said thumb wheel results in sliding action of the slide means which causes a scissors effect on the cam pins and forces the cam pins up and down the cams thus raising and lowering the rib.

3. In a shotgun as recited in claim 1 wherein said means pivotally mounting said elongated rib on said barrel comprises a cam means on the rear of said barrel, means pivotally and slidably mounting the rear end of said rib on said cam means and means on the forward end of the barrel for selectively adjusting the elevation of the forward end of said rib.

4. In a shotgun as recited in claim 3 wherein said means for selectively adjusting the forward end of said rib comprises a bracket mounted on the forward end of the barrel, an inclined cam surface on said bracket, a slide member attached to the rib and slidably engaged to said inclined cam surface, and means for locking said slide member at one of a plurality of points on said bracket inclined cam surface.

5. In a shotgun as recited in claim 4 wherein said slide member locking means comprises a detent plunger that is spring biased into one of a series of detents located on said bracket inclined cam surface.

6. In a shotgun as recited in claim 1 wherein means are provided for selectively adjusting one end of the rib, said selectively adjusting means comprising an elongated threaded member connected to said rib, a bracket mounted on said barrel having a slot therein, a knob positioned in said slot and confined therein to turn said knob in said bracket, said knob having a threaded opening in which the threaded member is engaged whereupon rotation of the knob clockwise will cause the threaded member to move the rib in one vertical direction and rotation of the adjustable knob counterclockwise will cause the rib to move in the opposite vertical direction.

7. In a shotgun as recited in claim 6 wherein said bracket and said threaded member have cam slots thereon that are opposed to each other, a cam pin extending through said cam slots and connected to said elongated rib, said cam pin being moved up and down said cam slots to raise and lower the rib depending on the direction of rotation of said knob.

8. In a shotgun as recited in claim 6 wherein means are provided for selectively locking said knob in the desired position.

9. In a shotgun as recited in claim 8 wherein said knob locking means comprises a detent plunger that is spring biased into one of a series of detents formed in the knob.

10. In a shotgun as recited in claim 9 in which said threaded member has an elongated cavity, a guide pin having one end secured to said bracket and the other end inserted in said elongated cavity for guiding the threaded member in its linear movement.

11. In a shotgun as recited in claim 3 wherein said means for selectively adjusting the forward end of the rib comprises a bracket mounted on the forward end of the barrel, an inclined cam surface on said bracket, a slide member attached to the rib and slidably engaged to said inclined cam surface, and screw means for selectively moving said slide along the cam surface to change the elevation of the elongated rib.

12. In a shotgun as recited in claim 3 wherein said means for selectively adjusting the forward end of the rib comprises a rack and pinion means including an elongated rack pivotally connected to the forward end of the rib and a pinion on the barrel positioned to engage and move said rack and the connected rib to the desired elevation.

13. In a shotgun as recited in claim 12 wherein means are provided for selectively locking the rack in the desired position.

14. In a shotgun as recited in claim 13 wherein said rack locking means comprises a spring biased detent that engages one of a plurality of notches on the rack.

15. In a shotgun as recited in claim 3 wherein said means for selectively adjusting the elevation of the forward end of the rib comprises a bracket mounted on the forward end of the barrel, a plurality of openings in said bracket spaced in a line having a greater angle from the horizontal than said cam means, a front cam pin selectively positioned in one of said openings and connected to said rib, the vertical adjustment of said rib being effected by positioning said front cam pin in the opening to give the desired elevation of the rib.

16. In a shotgun as recited in claim 1 wherein said means mounting said elongated rib on said barrel comprises an adjusting cam means on said barrel on which the rear portion of said rib is pivotally and slidably mounted, and means adjustably mounting the front end of said elongated rib to said barrel, the relationship of said front and rear mounting means being such that vertical movement of said rib relative to said barrel causes the forward and rear ends of the rib to move vertically and horizontally in differing degrees so that the effective pivot point of the rib is to the rear of the rib at a point approximating the position of the shooter's eye.

17. In a shotgun as recited in claim 16 wherein said front adjustable mounting means comprises a second adjusting cam means having a different pitch than said first cam means so that when the rib is moved for adjustment, the front end of the rib moves a greater distance vertically relative to the barrel than the rear end of said rib although maintaining the same effective pivot point as determined by projecting a line rearwardly from the plane of the upper surface of the rib in the various positions of rib adjustment.

18. In a shotgun as recited in claim 17 wherein means are provided for selectively moving said elongated rib vertically and horizontally about said adjustable front and rear mounting means, said selectively moving means comprising a screw means connected to a pin means which is attached to said rib and to said rear adjusting cam means, whereupon rotation of said screw means causes said rib to move vertically and longitudinally relative to the gun barrel, the movement of the rib depending on the direction the screw means is rotated.

19. In a shotgun as recited in claim 17 wherein means are provided for selectively moving said elongated rib vertically and horizontally about said adjustable front and rear mounting means, said selectively moving means comprising a bracket positioned intermediate the ends of said rib, means attaching an upper portion of said bracket to said rib, means pivotally mounting a lower portion of said bracket to said gun barrel, and longitudinally movable means attached to said bracket for causing said bracket to pivot on said bracket pivot means whereupon vertical and horizontal adjustment of said rib results.

20. In a shotgun as recited in claim 19 wherein said longitudinally movable means for causing said bracket to pivot on said bracket point means comprises a connecting rod means attached to said bracket and extending rearwardly thereof, said connecting rod means, upon being rotated, selectively acting a longitudinal direction to rotate the bracket about sid pivot means and move said rib to the desired position.

21. In a shotgun as recited in claim 20 wherein said connecting rod means comprises a plurality of peripherally spaced notches, a detent means selectively engageable in one of the notches to provide a positive lock means to hold the rib in the desired position.

22. In a shotgun as recited in claim 17 wherein means are provided for selectively moving said elongated rib vertically and horizontally about said adjustable front and rear mounting means, said selectively moving means comprising a bracket positioned intermediate the ends of the rib, means slidably mounting said bracket on said barrel, means attaching said bracket to said rib and permitting limited vertical movement therebetween, and means for moving said bracket in a longitudinal direction to cause said rib to be cammed at its front and rear mounting means for selective positioning of said rib.

23. In a shotgun as recited in claim 22 wherein said means moving said bracket in a longitudinal direction comprises a connecting rod attached to said bracket and extending rearwardly thereof, said connecting rod, upon being rotated, selectively acting to move the bracket in a longitudinal direction and cause the rib to be pivoted at its front and rear cam mounting means.

24. In a shotgun as recited in claim 23 a plurality of peripherally spaced notches on said connecting rod, and detent means mounted on said barrel for selectively engaging one of said notches for locking said connecting rod and holding the rib in the desired position.

25. In a shotgun as recited in claim 1 wherein said rib mounting means comprises a pair of longitudinally spaced and differentially pitched cam means mounted on said barrel, a pair of pin means on said rib engaging said cam means so that upon longitudinal movement of the rib relative to the barrel, said pin means move vertically and horizontally along said cam means to pivot the rib vertically relative to said barrel.

* * * * *